United States Patent [19]

Loeschen

[11] 4,313,587

[45] Feb. 2, 1982

[54] SHELF BRACKET

[75] Inventor: Lester L. Loeschen, Mishawaka, Ind.

[73] Assignee: Kwik-Mount Corporation, Mishawaka, Ind.

[21] Appl. No.: 54,669

[22] Filed: Jul. 5, 1979

[51] Int. Cl.[3] ..... A47G 29/02

[52] U.S. Cl. ..... 248/217.2; 248/235

[58] Field of Search ..... 248/71, 216.4, 217.2, 248/235, 247, 248, 250, 226.5, 300

[56] References Cited

U.S. PATENT DOCUMENTS

| | | | |
|---|---|---|---|
| 572,368 | 12/1896 | Porter | 248/300 X |
| 964,376 | 7/1910 | Blackburn | 248/217.2 X |
| 1,413,035 | 4/1922 | Koup | 24/138 R |
| 1,842,786 | 1/1932 | Kirsch | 248/300 X |
| 3,041,033 | 6/1962 | Schwartz | 248/248 |
| 3,158,348 | 11/1964 | Rutter | 248/217.2 X |
| 4,184,660 | 1/1980 | Anderson | 248/235 |

FOREIGN PATENT DOCUMENTS

| | | | |
|---|---|---|---|
| 1353256 | 3/1963 | France | 248/239 |

*Primary Examiner*—William H. Schultz
*Attorney, Agent, or Firm*—Marmaduke A. Hobbs

[57] ABSTRACT

A shelf bracket to be mounted on an exposed wall stud in which rearwardly extending portions of the bracket's side walls are attached one on each side of the stud, and the side walls are integral with reinforcing members and the bracket's top panel. Knurled or ribbed inwardly projecting portions on the interior surface of the side walls become embedded in the stud when the bracket is attached. The interior distance between the side walls of the bracket is slightly less than the width of a stud so that the walls must be spread slightly to slide over the stud. A plurality of brackets are used to support a shelf board which is attached to the top panel of the brackets.

7 Claims, 6 Drawing Figures

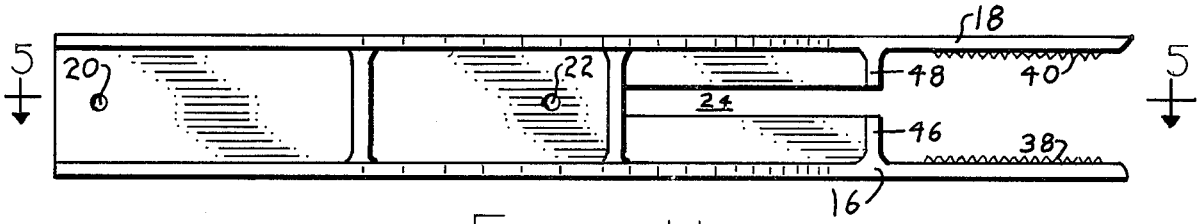
Fig. 4
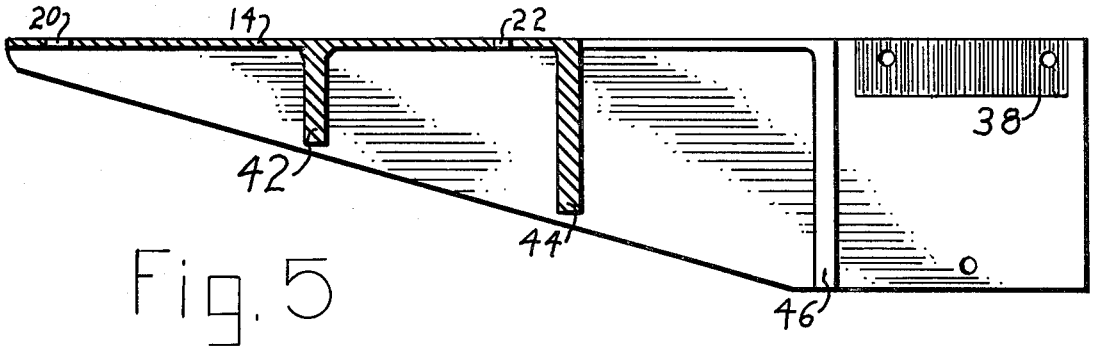
Fig. 5
Fig. 6
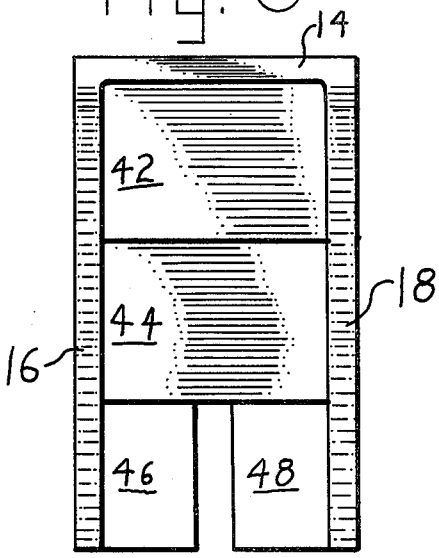

SHELF BRACKET

Storage is very often a problem for the average home owner, especially for such items as motor oils, paints, garden tools and other miscellaneous items. Garages, work shops and utility buildings have been the most common location for the storage of these miscellaneous goods. To provide order and neatness to such a building when used for storage and to prevent large accumulations on the floor from occurring, shelves are often attached to the walls so that the articles may be placed on the shelves in a neat and orderly fashion and therefore be readily accessible. Frequently, especially in garages, the inside walls are not finished, i.e. interior wall panels are not provided, thereby leaving the wall studs exposed to the interior of building. A common method for attaching shelves to this type of wall includes using L-shaped brackets attached to the interior edge of the wall stud and then attaching a shelf board to the portion of the L-bracket perpendicular to the stud. These brackets have been unsatisfactory, in that in order to provide sufficient support for a shelf which will accommodate very large or heavy objects, the bracket must be quite large and heavy to provide sufficient rigidity in its L-shaped form to support the shelf.

A second common method for building shelves in buildings with unfinished interior walls includes cutting and nailing support boards to the wall studs and then attaching the shelf board to the support boards. While this design normally works satisfactorily, it is time consuming to build and, unless constructed properly, is unreliable and fails to support the intended load of articles and materials. Further, many home owners do not have the necessary carpentry skills to build a shelf system of pleasing appearance in this manner, since angular cuts and mitered corners are usually required, and once such a shelf is built, it is difficult to remove or relocate.

It is therefore one of the principal objects of the present invention to provide a shelf bracket which is light in weight and which can be easily and quickly attached to an exposed wall stud, yet which is sufficiently rigid and strong to support a shelf board to accommodate relatively heavy objects, and which will create a shelf or shelf system having a pleasing appearance.

Another object of the present invention is to provide a shelf bracket which can be easily and quickly attached to the exposed studs in a wall, yet which can also be easily removed from the studs and reattached quickly in another location if it is desired to move or adjust the shelf, thereby making organization of storage a relatively simple operation.

Yet another object of the present invention is to provide a shelf bracket which will slide over and yet firmly grip the studs to which it is attached by partially embedding itself therein, thereby providing firm support for the shelf board, and which can be attached to the stud and to the shelf board simply and easily using only one or two carpentry tools available to most home owners.

A further object of the present invention is to provide a shelf bracket which can be produced relatively inexpensively in a variety of lengths for various width shelves, and which, with its easy method of attachment, will encourage the safe and orderly storage of the miscellaneous articles which otherwise tend to accumulate on garage and basement floors.

Further objects and advantages of the present invention will be obvious from the following detailed description and drawings, wherein:

FIG. 4 is a plan view of the bottom of the shelf bracket;

FIG. 5 is a cross sectional view taken on line 5—5 of FIG. 4, showing more clearly the reinforcing structure of the shelf bracket; and FIG. 6 is an elevational view of the front end of the shelf bracket.

Figure 1:
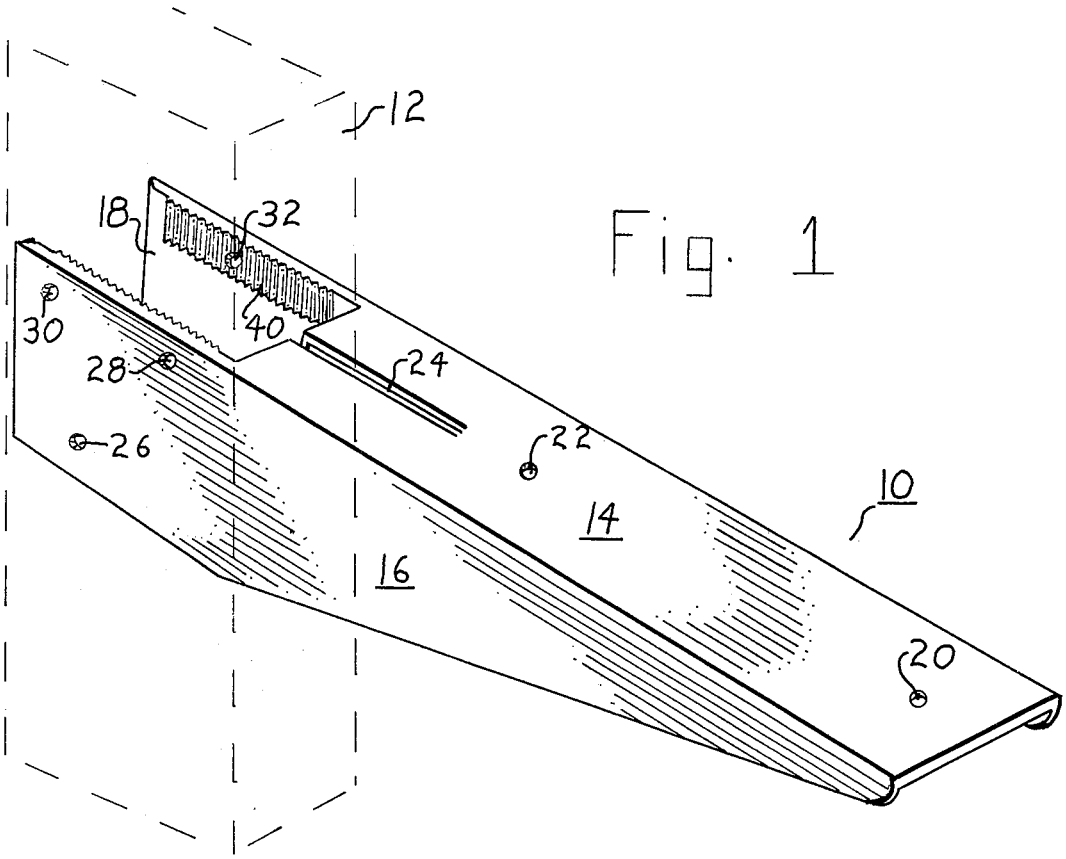
FIG. 1 is a perspective view of a shelf bracket embodying the present invention, illustrating it attached to a stud shown by broken lines.
Figure 2:
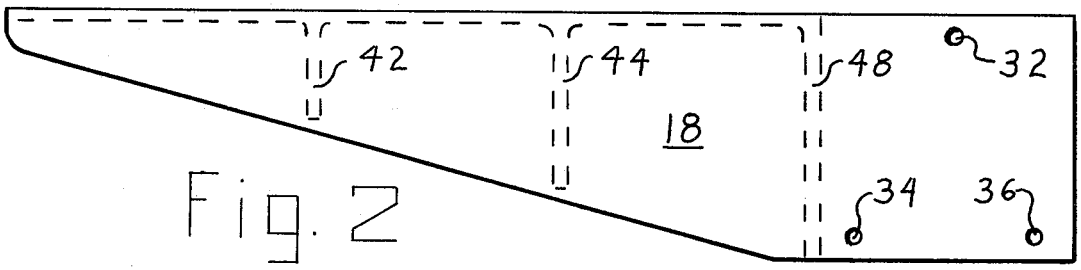
FIG. 2 is a side elevational view of the shelf bracket shown in FIG. 1, with interior portions of the bracket shown by broken lines.
Figure 3:
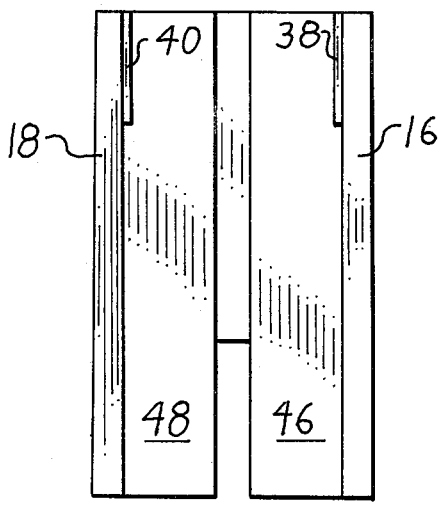
FIG. 3 is an elevational view of the rear end of the shelf bracket.

Referring more specifically to the drawings, and to FIG. 1 in particular, numeral 10 designates a shelf bracket constructed in the manner of the present invention, mounted on wall stud 12, which is indicated by phantom lines. Shelf bracket 10, which is of a unitary plastic construction, consists of a top 14 and side wall panels 16 and 18. Top panel 14 terminates forwardly from the rear end of the side wall panels sufficiently to allow the bracket to be placed over a wall stud, so that the rear portions of the side wall panels are positioned on the opposite side surfaces of the stud, and the rear edge of top panel 14 abuts against the interior edge of the stud. Top panel 14 has two holes or knock-out portions 20 and 22 through which screws, nails or other attachment devices may be inserted to secure a shelf board to bracket 10 after the bracket has been attached to the wall stud. Extending forwardly from the rear edge of top panel 14 is a slot 24 which will allow the rear edge of top panel 14 and the rear portions of side wall panels 16 and 18 to be spread slightly when the bracket is placed around the stud. This is necessary because, in the preferred embodiment, the interior distance between side wall panels 16 and 18 is slightly less than the width of an average wall stud, thereby providing a firm grip by the bracket to the stud in a manner which will be described in greater detail hereinafter.

Side wall panels 16 and 18 are similar in shape, being basically rectangular on their rear portions which slide over the stud, and having triangular shaped forwardly extending portions which are straight on the top edge and tapering on the bottom edge upwardly toward the front of the bracket. Each of side walls 16 and 18 is provided with three holes or knock-out portions for inserting nails or screws to attach the bracket to the stud. Wall panel 16 has holes 26, 28 and 30, and side wall 18 has holes 32, 34 and 36. Side wall 16 has two of the holes positioned near its upper edge and one near its lower edge, which is spaced downwardly from but positioned horizontally between the two upper holes. The opposite hole configuration is provided on side wall 18, with one hole near its upper edge and two near the lower edge. This arrangement eliminates the possibility of the screws or nails inserted into the stud from one side of the bracket interfering with those inserted from the other side. The side wall panels 16 and 18 have on their inner surfaces, located near the upper edge thereof in the rectangular portion, inwardly projecting knurled or ribbed portions 38 and 40, respectively. These knurled portions are embedded in the side surfaces of the stud when the bracket is mounted on the stud to provide a firm, nonsliding attachment of the bracket to the stud.

Reinforcement members 42 and 44 are disposed between side wall surfaces 16 and 18 and are formed integrally with the side walls and with top panel 14. These members provide reinforcement, both horizontally and vertically, being integral with both side walls and the top panel. At the rear edge of top surface 14, reinforcement members 46 and 48 are disposed on either side of slot 24 and are spaced from each other a distance equal to the width of slot 24. These members perform substantially the same function as reinforcement members 42 and 44; however, they are not connected to each other but are disposed on either side of slot 24 to provide reinforcement but also to allow for lateral movement of the rear edge of top panel 14 and the side walls at that point. When the bracket is placed on the stud, members 46 and 48 will contact the edge of the stud, thereby providing a further vertical support and stability to the bracket mounted on the stud.

In the use and operation of a shelf bracket embodying the present invention, the bracket is slid over the wall stud, thus causing the rear portions of the sides to spread slightly, since the distance between the interior surfaces of the side walls 16 and 18 is slightly less than the width of the wall stud. This can be done by simply spreading the rear portions and sliding them over the wall stud. Slot 24, which extends forward from the rear edge of the top panel, permits slight movement of the top surface in that area, which is required when the side walls are spread. Reinforcement members 46 and 48, each being attached only to one side wall and the top panel on one side of slot 24, do not interfere with the spreading of the rear portions of the bracket. Forward of slot 24 at reinforcement member 44 no further distortion of the side walls or top panel is necessary to slide the bracket over the wall stud. The bracket is positioned on the wall stud so that members 46 and 48 make flush contact with the stud, thus aiding the horizontal leveling of the bracket, since by holding the bracket flush against the stud, the bracket, too, will be level.

Once in position on the wall stud and located at the height desired, the bracket is secured by screws or nails inserted in holes 26, 28 and 30 of side wall 16 and holes 32, 34 and 36 of side wall 18, the screws or nails being driven into the wall stud firmly to attach the bracket firmly to the stud. Because of the location of the holes, even though six nails or screws will be located in a small area, the installer need not be concerned with their interfering with each other. As the side panels of the bracket are drawn closer to the stud, knurled portions 38 and 40 embed themselves in the surfaces of the wall stud. This provides a more firm attachment of the bracket to the wall stud, since any play which may result from a loose fit of the nails or screws in the holes of the side panels is eliminated by the knurled edges embedded in the stud. Members 46 and 48, being flush against the stud, also help reduce any play which may result.

A series of this type of bracket may be attached to various wall studs to obtain the length of shelf desired, and the support necessary for whatever types of items are going to be stored on the shelf. They can be placed on each successive stud to provide support for heavy objects, or on alternate studs for lighter storage. Once a sufficient number of brackets have been attached, a shelf board is then laid across the brackets and again attached by either nails or screws inserted from the underside of top panel 14 through holes 20 and 22.

The shelf bracket may be molded out of any suitable rigid plastic material, preferably as an integral unit, and reinforcing members 42, 44, 46 and 48, being molded integrally with the walls and top panel, impart sufficient rigidity and strength to the bracket that relatively thin walls having adequate strength to support relatively heavy loads can be used. The tapered design and rounded front edge provide a pleasant appearing shelf system when used with a finished shelf board or the like, and the bracket can be made for a variety of widths of shelves. If screws or double-headed scaffold nails are used to attach the bracket to the stud, they can be easily removed without damaging the bracket. Hence, various rearrangements of the shelving can easily and quickly be made from time to time to meet changing conditions.

Although one embodiment has been described in detail herein, various other modifications and variations can be made without exceeding the scope of the present invention.

I claim:

1. A shelf bracket for mounting on an exposed wall stud, comprising a generally horizontal top panel and first and second side walls, each of said side walls having a rearwardly extending portion spaced laterally from one another for receiving a stud therebetween, said top panel being disposed between the upper edges of said side walls, a slot disposed in said top panel extending from the end of said top panel nearest said rearwardly extending portions of said side walls and forwardly therefrom, reinforcing members disposed on opposite sides of said slot and joined integrally with the respective side walls and connected to the respective portions of said top panel on opposite sides of said slot adjacent said rearwardly extending side wall portions, and a plurality of spaced reinforcing members disposed between said walls forwardly with respect to said slot and joined integrally to the inner side of at least one of said side walls.

2. A shelf bracket as defined in claim 1 in which said plurality of reinforcing members are disposed vertically between said side walls and are connected integrally to said top panel and said side walls.

3. A shelf bracket as defined in claim 1 in which said reinforcing members on each side of said slot are disposed at the rear end of said top panel for contacting the edge of the stud on which the bracket is mounted, thereby providing increased support for the bracket.

4. A shelf bracket as defined in claim 1 in which inwardly extending knurled portions are disposed on the inner surface of each of said rearwardly extending portions, for being embedded in the wall stud when the bracket is attached thereto.

5. A shelf bracket as defined in claim 3 in which inwardly extending knurled portions are disposed on the inner surface of each of said rearwardly extending portions, for being embedded in the wall stud when the bracket is attached thereto.

6. A shelf bracket as defined in claim 5 in which an upper hole and two lower holes are provided in one of said rearwardly extending portions, and two upper holes and a lower hole are provided in the other of said rearwardly extending portions through which nails and screws may be inserted to attach said shelf bracket to a wall stud.

7. A shelf bracket as defined in claim 6 in which holes are provided in said top surface through which nails and screws may be inserted to attach a shelf board between a plurality of said shelf brackets.

* * * * *